US008695236B2

(12) United States Patent
Nishiwaki et al.

(10) Patent No.: US 8,695,236 B2
(45) Date of Patent: Apr. 15, 2014

(54) SHOE SOLE SUITABLE FOR SUPPRESSING PRONATION

(75) Inventors: Tsuyoshi Nishiwaki, Hyogo (JP); Seigo Nakaya, Hyogo (JP); Kenta Moriyasu, Hyogo (JP); Kiyomitsu Kurosaki, Hyogo (JP)

(73) Assignee: ASICS Corporation, Hyogo (JP)

( * ) Notice: Subject to any disclaimer, the term of this patent is extended or adjusted under 35 U.S.C. 154(b) by 586 days.

(21) Appl. No.: 13/125,137

(22) PCT Filed: Oct. 27, 2008

(86) PCT No.: PCT/JP2008/069431

§ 371 (c)(1),
(2), (4) Date: Apr. 20, 2011

(87) PCT Pub. No.: WO2010/049983

PCT Pub. Date: May 6, 2010

(65) Prior Publication Data

US 2011/0197469 A1 Aug. 18, 2011

(51) Int. Cl.
*A43B 7/24* (2006.01)
*A43B 13/18* (2006.01)

(52) U.S. Cl.
CPC ..... *A43B 7/24* (2013.01); *A43B 13/186* (2013.01)
USPC ..... 36/142

(58) Field of Classification Search
CPC ..... A43B 7/14; A43B 7/1475; A43B 7/148; A43B 7/1485; A43B 7/24; A43B 13/00; A43B 13/12; A43B 13/125; A43B 13/127; A43B 13/186
See application file for complete search history.

(56) References Cited

U.S. PATENT DOCUMENTS 2,885,797 A * 5/1959 Chrencik ..... 36/91
4,364,188 A * 12/1982 Turner et al. ..... 36/31

(Continued)

FOREIGN PATENT DOCUMENTS

JP 56-11605 U 1/1981
JP 3-118006 U 12/1991

(Continued)

OTHER PUBLICATIONS

International Search Report for corresponding International Application No. PCT/JP2008/069431 mailed Nov. 25, 2008.

*Primary Examiner* — Marie Bays
(74) *Attorney, Agent, or Firm* — Renner, Otto, Boisselle & Sklar, LLP

(57) ABSTRACT

Three or more holes are formed in a lower portion of a first area D1 in a midsole body 29 separated from one another in a front-rear direction Y, each hole opened in a downward direction and having an inner peripheral surface about an axial line extending in an up-down direction; embedded portions each have an outer peripheral surface about the axial line, and are embedded in the midsole body 29 while being fitted into the holes; the embedded portions are formed by a hard member 4 made of a resin harder than midsole bodies 20 and 29 and outsoles 5 and 5A; and the hard member 4 includes a connecting portion for connecting together the embedded portions in the front-rear direction Y on the lower surface of the midsole body 29.

17 Claims, 17 Drawing Sheets

(56) References Cited

U.S. PATENT DOCUMENTS

| | | | | |
|---|---|---|---|---|
| 4,510,700 | A * | 4/1985 | Brown | 36/44 |
| RE33,648 | E * | 7/1991 | Brown | 36/44 |
| 5,282,288 | A * | 2/1994 | Henson | 12/142 P |
| 5,894,682 | A * | 4/1999 | Broz | 36/31 |
| 6,199,302 | B1 | 3/2001 | Kayano | |
| 2006/0283044 | A1 | 12/2006 | Lacey | |
| 2008/0196272 | A1 * | 8/2008 | Hay et al. | 36/88 |
| 2011/0197469 | A1 * | 8/2011 | Nishiwaki et al. | 36/28 |

FOREIGN PATENT DOCUMENTS

| | | | |
|---|---|---|---|
| JP | 4-25501 | U | 2/1992 |
| JP | 2004-242692 | A | 9/2004 |
| JP | 2006-025990 | A | 2/2006 |
| WO | 2005/060781 | A1 | 7/2005 |

* cited by examiner

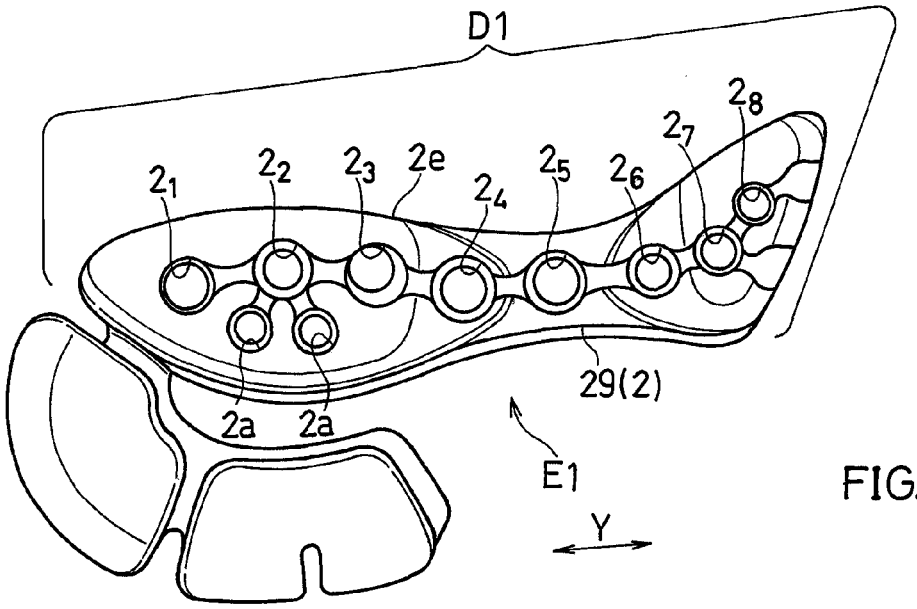
FIG. 4A
FIG. 4B
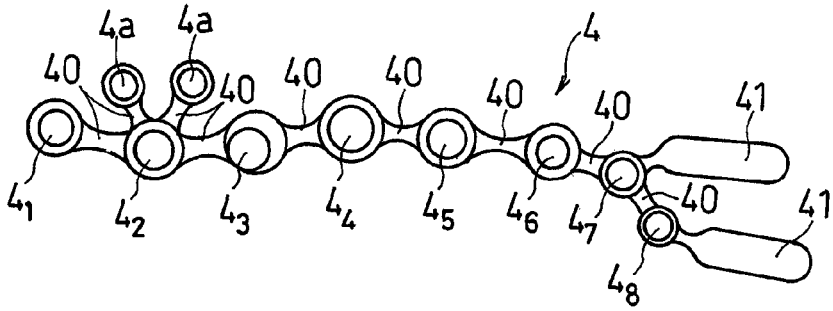
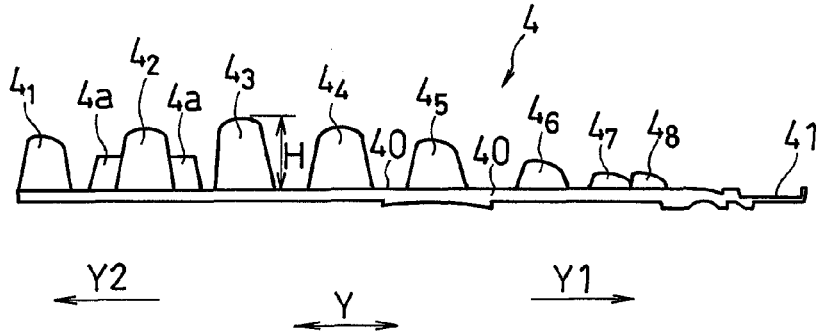
FIG. 4C 29
29d
2a
2a
2a

SHOE SOLE SUITABLE FOR SUPPRESSING PRONATION

TECHNICAL FIELD

The present invention relates to a shoe sole suitable for suppressing pronation.

BACKGROUND ART

When running, each foot lands on the lateral side of the heel and then the center of the load moves to the medial side of the front foot portion. In this process, the heel pronates. Suppressing excessive pronation serves to prevent leg injuries due to running.

U.S. Pat. No. 6,199,302 discloses a shoe sole in which the medial side of the middle foot portion and the rear foot portion of the midsole is formed by a harder material than other portions of the midsole.

[First Patent Document] U.S. Pat. No. 6,199,302 (FIG. 1)

DISCLOSURE OF THE INVENTION

However, with a midsole of a higher hardness and a midsole of a lower hardness, there is an abrupt hardness difference at the boundary therebetween. Therefore, the wearer may feel an upthrust on the foot sole (plantar surface) at the boundary.

Japanese Laid-Open Patent Publication No. 2004-242692 discloses a shoe sole aiming at suppressing excessive pronation. With this conventional technique, a plurality of holes are formed in the midsole with a hard protrusion inserted in each hole.

With this conventional technique, however, a plurality of protrusions need to be attached to, or insert-molded integrally with, a wave-shaped plate. Integrating each protrusion, one by one, with the wave-shaped plate is time-consuming, and the fixing positions are likely to be wrong.

In the conventional technique, the protrusions are provided on the midsole on the medial side of the rear foot portion. However, as clearly shown in FIG. 6 of this conventional technique, the portion of the midsole above the protrusions is formed to be thicker toward the medial edge. When the foot leans to the medial side, such a portion close to the medial edge is compressed. Therefore, it will not be able to sufficiently suppress pronation.

WO2005/060781 discloses a shoe sole in which a plurality of hard shock-absorbing portions is inserted into through holes of a soft shock-absorbing element, with the shock-absorbing element inserted into a cutout in the shoe sole.

However, the plurality of hard shock-absorbing portions are separated from one another. Therefore, with this conventional technique, the operation of inserting the shock-absorbing portions into the element is time-consuming.

The thickness of the element is constant. Therefore, the midsole will be greatly compressed in portions close to the medial edge.

Japanese Laid-Open Utility Model Publication No. 4-25501 discloses a shoe sole in which columnar fillers are inserted into through holes in the midsole. With the conventional technique, however, the fillers are provided in the medial-lateral central portion of the foot, and this conventional technique will therefore not contribute to the suppression of pronation.

A primary object of the present invention is to provide a shoe sole with which it is unlikely that one feels an upthrust on the foot sole (plantar surface), and which can suppress pronation.

In order to achieve the object set forth above, a shoe sole of the present invention suitable for suppressing pronation is a shoe sole suitable for suppressing pronation, wherein: the shoe sole includes a front foot portion, a middle foot portion and a rear foot portion continuous with one another in a front-rear direction of a foot, the shoe sole including: a midsole having an upper surface and a lower surface and absorbing an impact of landing; and an outsole having a bonded surface to be bonded to the lower surface of the midsole, and a ground contact surface (tread surface) to be in contact with a road surface; the midsole includes a midsole body formed by a foamed resin; the midsole body is provided in a first area including a medial side of the middle foot portion and/or a medial side of the rear foot portion, and in a second area including the front foot portion, the middle foot portion and the rear foot portion excluding the first area; three or more holes are formed in a lower portion of the first area in the midsole body separated from one another in the front-rear direction, each hole opened in a downward direction and having an inner peripheral surface about an axial line extending in an up-down direction; three or more embedded portions are provided; the embedded portions each have an outer peripheral surface about the axial line, and are embedded in the midsole body while being fitted into the holes; the embedded portions are formed by a hard member made of a resin harder than the midsole body and the outsole; and the hard member includes a connecting portion for connecting together the embedded portions in the front-rear direction on the lower surface of the midsole body.

According to the present invention, the hard embedded portions hardly undergo compressive deformation in the up-down direction due to impact of landing. Therefore, the medial side of the middle foot portion and/or the rear foot portion where the hard embedded portions are provided less easily undergoes compressive deformation. Thus, pronation is suppressed.

On the medial side of the middle foot portion and/or the medial side of the rear foot portion, the foot sole is supported by an upper portion of the first area of the midsole body which is soft, and it is therefore unlikely that one feels an upthrust on the foot sole.

The embedded portions often differ from one another in size or height. As the embedded portions are connected together by the connecting member, the relationship between embedded portions and holes (in size or height) will not be mistaken.

Since the embedded portions are connected together by the connecting member, the embedded portions can be attached to the holes at once, thus facilitating the attachment of the embedded portions.

Where the midsole includes a plate made of a non-foamed resin to be described later, the height of the highest embedded portion is preferably about 50% to about 100% of the thickness of the midsole body, and more preferably about 65% to about 100% of the thickness of the midsole body, and most preferably about 75% to about 100% of the thickness of the midsole body.

Where the midsole does not include the non-foamed resin plate, the height of the highest embedded portion is preferably about 50% to about 90% of the thickness of the midsole body, more preferably about 65% to about 90% of the thickness of the midsole body, and most preferably about 75% to about 90% of the thickness of the midsole body.

Note that the height of the highest embedded portion is preferably about 10 mm to about 25 mm. If the height is less than 10 mm, there will be little pronation suppressing effect. On the other hand, if the height is over 25 mm, it will present a cause of an upthrust.

The shape of the embedded portion is preferably a truncated cone. A truncated cone-shaped embedded portion is unlikely to be buckled.

The average cross-sectional area of the largest hole is preferably about 0.5 $cm^2$ to about 3.0 $cm^2$. If the area is smaller than 0.5 $cm^2$, there is a need for increasing the number of holes. On the other hand, if the area is over 3.0 $cm^2$, the cross-sectional area of the embedded portion to be fitted into the hole will be large, thus making the shoe sole heavy.

Depending on the size of each hole, the number of holes is preferably 25 or less, and more preferably 15 or less. If the number of holes is excessive, there is a need for reducing the cross-sectional area of the hole. Then, the embedded portions will be long and narrow.

The number of holes may be equal to the number of embedded portions, or the number of holes may be greater than the number of embedded portions in a case where a single midsole mold is used for different midsoles or in a case where the degree of pronation suppression is allowed to be easily adjusted as necessary by the number of embedded portions.

In the present invention, "holes are separated from one another in the front-rear direction" only requires that the holes are separated from one another with respect to the front-rear direction, and it encompasses a case where a hole is placed diagonally forward or rearward of another hole.

The "inner peripheral surface of the hole" means that the periphery of the hole is continuous, and the cross section of the hole does not need to have a circular shape, but may have a triangular shape, a square shape, a polygonal shape, etc. Similarly, the "outer peripheral surface of the embedded portion" means that the cross-sectional shape of the embedded portion does not need to have a circular shape. For example, the embedded portion may have a hollow shape such as a tubular shape. The embedded portion may also have a tubular shape with its top surface closed, or a tubular shape with the bottom surface.

In the present invention, it is preferred that a first hole having a largest cross-sectional area along a cross section perpendicular to the axial line among the holes is placed in a middle portion of the first area in the front-rear direction.

If the cross-sectional area of the hole is large, the cross-sectional area of the hard member is also large, and therefore the degree of increase in the rigidity from the hard member is high. In this embodiment, the cross-sectional areas of the holes on opposite ends in the front-rear direction near the boundary between the first area and the second area are small, and the cross-sectional area of the hard member is also small on opposite ends in the front-rear direction. Therefore, the transition of rigidity between the first area and the second area is unlikely to be felt. Therefore, it is unlikely that one feels an upthrust.

In the present invention, where the hole has a truncated cone shape, the cross-sectional area of the hole can be determined in terms of the average value.

In the present invention, it is preferred that a first embedded portion having a largest height among the embedded portions is placed in a middle portion of the first area in the front-rear direction.

When the height of the embedded portion is large, the height of the midsole body which does not deform due to the hard member, i.e., a lower portion of the first area, is also large. In this embodiment, since the embedded portions on opposite ends in the front-rear direction are low, one is unlikely to feel the difference in rigidity between the first area and the second area. Therefore, it is unlikely that one feels an upthrust.

In the present invention, it is preferred that a first embedded portion having a largest height among the embedded portions is placed on a medial side of a front portion of a calcaneal bone or at a position more medial of the front portion of the calcaneal bone; the embedded portions other than the first embedded portion have gradually smaller heights in a rearward direction past the first embedded portion; and the embedded portions other than the first embedded portion have gradually smaller heights in a forward direction past the first embedded portion.

On the medial side of a front portion of the calcaneal bone, the arch is highest and the midsole is thick. Therefore, if the high first embedded portion is placed in this portion, there is a significant (large) pronation suppressing effect, and it is unlikely that one feels an upthrust on the foot sole.

In the present invention, it is preferred that a distance from the bonded surface of the outsole to the upper surface of the midsole increases toward an edge on the medial side, on the medial side of the middle foot portion and on the medial side of the rear foot portion; the edge on the medial side includes a narrowed portion in the middle foot portion; five or more embedded portions are provided from the middle foot portion to the rear foot portion; and the embedded portions are placed on a virtual curved line which is shaped along a medial edge of the middle foot portion and a medial edge of the rear foot portion and along the narrowed portion.

In this embodiment, embedded portions are provided both in the middle foot portion and in the rear foot portion and embedded portions are provided along the narrowed portion, and the number of embedded portions will therefore be five or more. If the number of embedded portions is four or less, the size of the embedded portions may be large, or one is likely to feel an upthrust on the foot sole. The portion of the midsole body along the medial edge is thickened in conformity with the rolled-up shape of the foot sole. The thickened portion easily undergoes compressive deformation. Therefore, by placing the embedded portions on a curve along this portion, there is a significant pronation suppressing effect.

In the embodiment above, it is preferred that each embedded portion has a top surface, and the top surface of the embedded portion is inclined so as to extend diagonally upward toward the medial edge.

In such a case, the top surface of the embedded portion has a shape in conformity with the shape of the lateral cross section of the foot sole. Therefore, there is an even more significant pronation suppressing effect.

In the present invention, it is preferred that a distance from the bonded surface of the outsole to the upper surface of the midsole increases toward an edge on the medial side, on the medial side of the middle foot portion and on the medial side of the rear foot portion; and each embedded portion has a top surface, and the top surface of the embedded portion is inclined so as to extend diagonally upward toward the medial edge.

In such a case, the top surface of the embedded portion has a shape in conformity with the shape of the lateral cross section of the foot sole. Therefore, there is a significant pronation suppressing effect.

In the present invention, it is preferred that the midsole body is further provided in an upper portion of the first area which is upward of the lower portion of the first area; and the top surface is inclined along an upper surface of the midsole body above each embedded portion whose top surface is inclined.

In such a case, the lower portion of the first area of the midsole body where the embedded portions are provided less easily undergoes compressive deformation. Moreover, the upper surface of the midsole body over the embedded portions is inclined generally parallel to the top surface. Therefore, even if the medial edge portion of the shoe sole is thick, the soft portion of the midsole over the embedded portions is not thick and thus undergoes little compressive deformation. As a result, there is a significant pronation suppressing effect.

In the embodiment above, it is preferred that on the medial side of the rear foot portion, an auxiliary embedded portion is provided in a portion closer to a center of a calcaneal bone than the embedded portion provided on the medial edge; and a height of the auxiliary embedded portion is smaller than that of the embedded portion provided on the medial edge.

In such a case, the lower portion of the first area of the midsole body where the auxiliary embedded portions are provided also less easily undergoes compressive deformation. The embedded portions provided on the medial edge are higher than the auxiliary embedded portions. Therefore, there is a significant pronation suppressing effect.

In the present invention, it is preferred that two or more of the embedded portions provided on the medial side of the rear foot portion are placed more medial of (than) a portion of a calcaneal bone excluding a sustentaculum talus of the calcaneal bone.

The medial and lateral malleoli protrude in the width direction with respect to the calcaneal bone. The calcaneal bone is not so large in the width direction of the foot excluding the sustentaculum talus portion. Therefore, the calcaneal bone easily leans to the medial side after landing on the lateral side of the rear foot portion.

Here, the sustentaculum talus is protruding to the medial side in an upper portion off the bottom surface of the foot. Therefore, by placing two or more embedded portions in a portion more medial than the calcaneal bone portion excluding the sustentaculum talus, it is possible to suppress medial leaning of the foot.

In the present invention, it is preferred that an upper surface of the connecting portion is secured to the lower surface of the midsole body.

In such a case, the connecting portion extending in the front-rear direction which is secured to the lower surface of the midsole body will contribute to the increase in the flexural (bending) rigidity of the midsole upon flexion (bending) of the foot.

In the embodiment above, the outer peripheral surface of each embedded portion may be secured to the midsole body on the inner peripheral surface of each hole, thereby suppressing compressive deformation in an up-down direction of the lower portion of the first area around the hole; and the lower portion of the first area thereby less easily undergoes compressive deformation than the midsole body in an upper portion of the first area and in the second area.

In this embodiment, the midsole body between holes is secured to the hard embedded portion and thus less easily undergoes compressive deformation. Therefore, the lower portion of the first area suppresses wave-like deformation of the midsole body in the upper portion of the first area. Therefore, it is even more unlikely that the wearer feels an upthrust due to the hard embedded portions.

In the present invention, it is preferred that the midsole includes a plate made of a non-foamed resin covering over the embedded portions in the first area; and the midsole body includes a lower midsole body bonded to a lower surface of the plate, and an upper midsole body bonded to an upper surface of the plate.

In this embodiment, since the plate is placed over the embedded portions, the wearer hardly feels an upthrust from the embedded portions.

In the embodiment above, it is preferred that each hole runs in an up-down direction through the lower midsole body.

In this embodiment, the precision of the depth of the hole is improved.

In the present invention, it is preferred that a color of the midsole body is different from a color of the hard member; and the outsole placed in the first area includes a see-through portion formed by a semitransparent rubber, and the hard member can be seen through the see-through portion from below the outsole.

In this embodiment, the shoe sole has good design aesthetics where, for example, the hard member is of a chromatic color and the midsole is of an achromatic color.

In the present invention, it is preferred that the outsole is made up of a plurality of parts, and a part placed in the first area includes a frame portion provided in a loop shape along a periphery of the see-through portion, and the see-through portion formed integrally with the frame portion; and the frame portion is formed by a black rubber in which carbon black is used as a reinforcing filler.

In this embodiment, one can enjoy the appearance of the hard member of a chromatic color, and carbon black used in the frame portion as a reinforcing filler increases the wear resistance of the peripheral portion which is easily worn away.

Note that while a pigment of a different color or a different reinforcing filler may be used, instead of carbon black, in the rubber of the frame portion, the wear resistance will then be lower as compared with the black rubber containing carbon black.

In the present invention, it is preferred that a JIS-C hardness of a material of the midsole body is set to 45° to 65°, and a JIS-A hardness of the hard member is set to 55° to 95°.

If the JIS-C hardness of the midsole body is less than 45°, the midsole body sinks significantly, and therefore the wearer feels an upthrust on the foot sole due to the hard member. On the other hand, if the JIS-C hardness of the midsole body is over 65°, there will not be sufficient cushioning.

If the JIS-A hardness of the hard member is less than 55°, the hard member may deform, thereby failing to sufficiently suppressing pronation. On the other hand, if the JIS-A hardness of the hard member is over 95°, the wearer may feel an upthrust due to the hard member.

BRIEF DESCRIPTION OF THE DRAWINGS

FIG. 4A is a bottom view showing a lower midsole body, FIG. 4B is a plan view showing a hard member, and FIG. 4C is a side view showing a hard member 4.

DESCRIPTION OF THE REFERENCE NUMERALS

Figure 1:
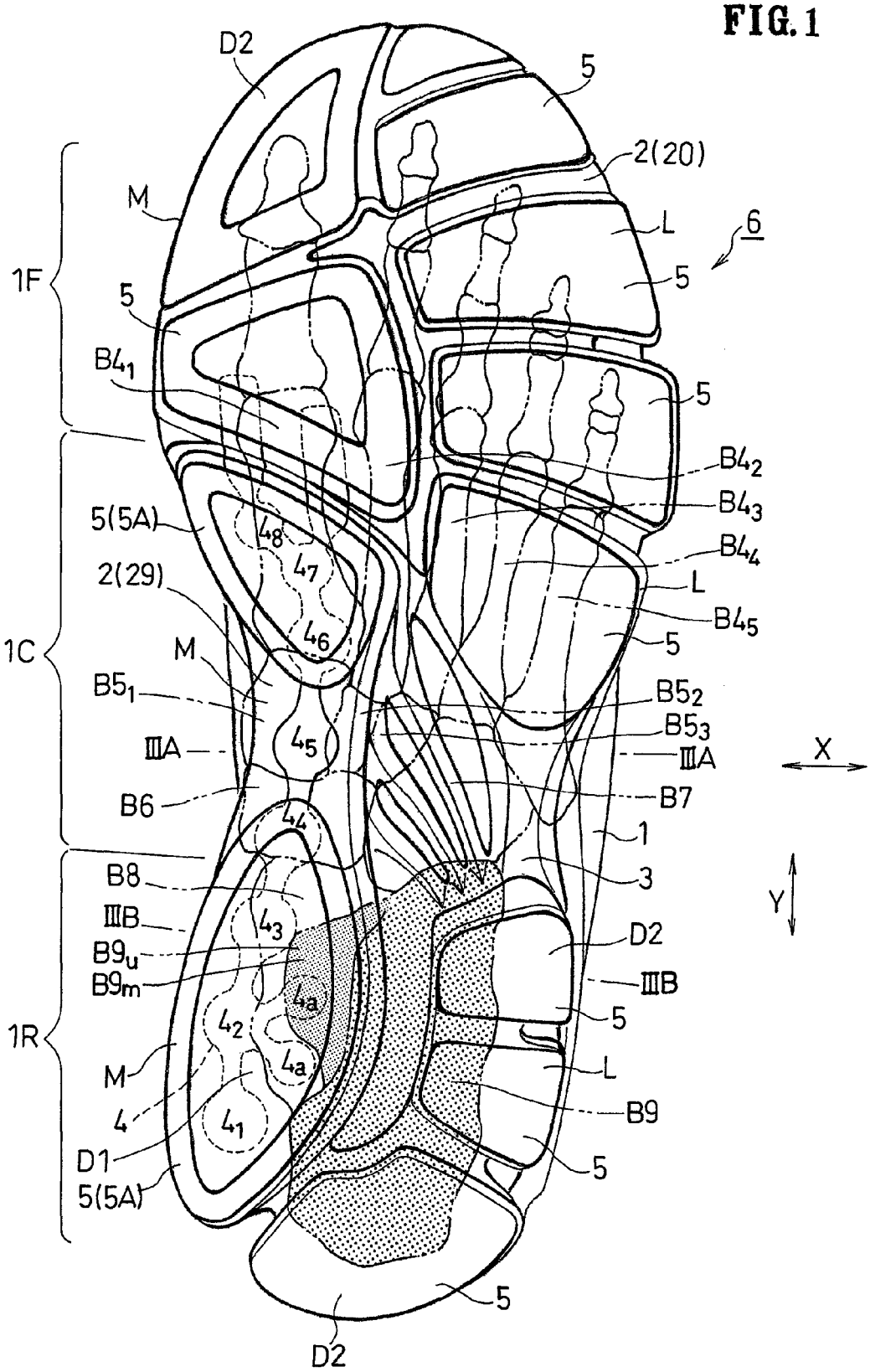
FIG. 1 is a bottom view showing a shoe sole according to Embodiment 1 of the present invention.
Figure 2:
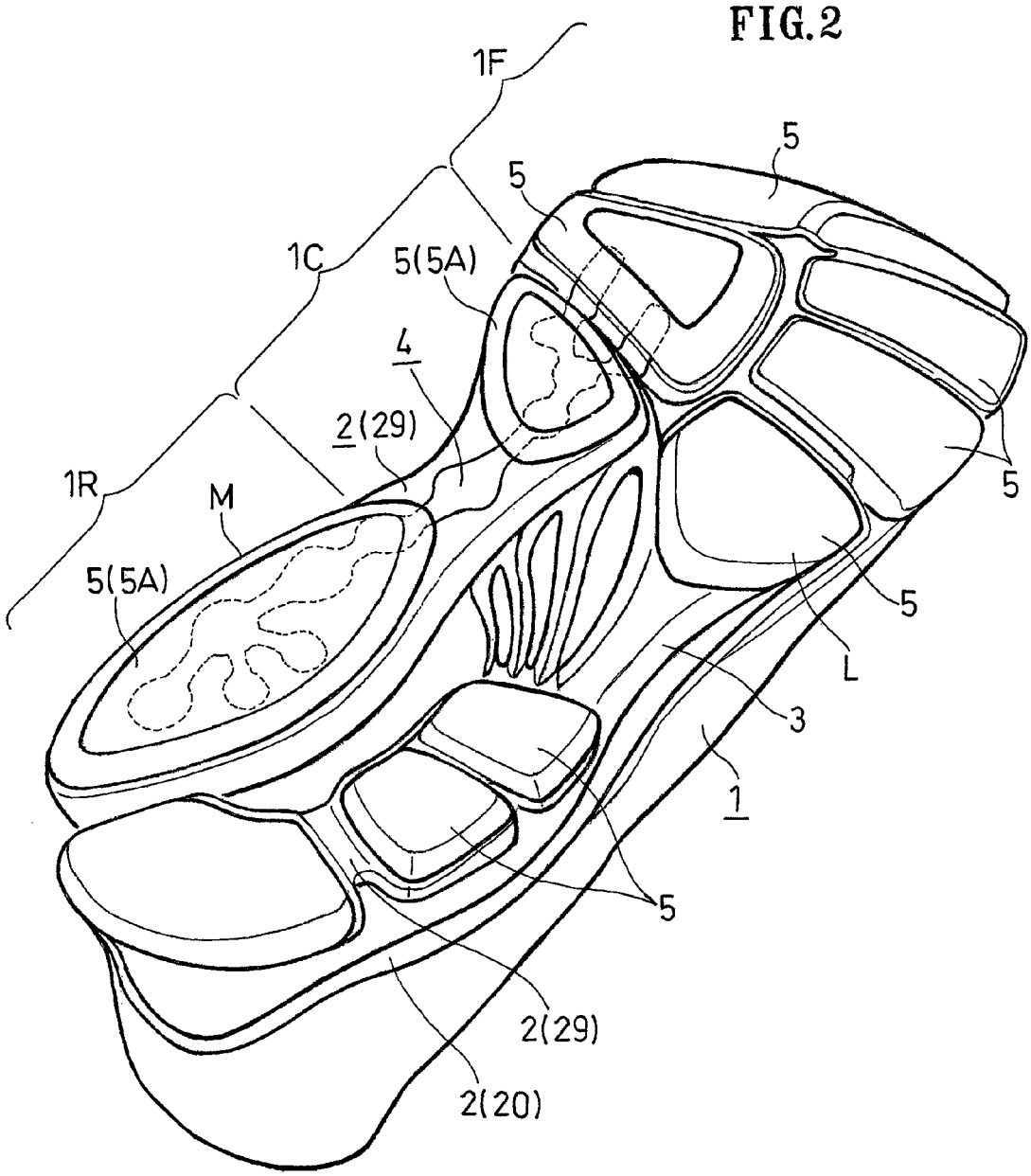
FIG. 2 is a perspective view showing a shoe having the shoe sole as seen from below.

1F: Front foot portion
1C: Middle foot portion
1R: Rear foot portion
2: Midsole
$\mathbf{2}_i$: Hole
$\mathbf{2}_4$: First hole
2*b*: Narrowed portion
2*d*: Lower surface
2*e*: Medial edge
2*u*: Upper surface
3: Heel cup (an example of the resin plate)
4: Hard member
$\mathbf{4}_i$: Embedded portion
$\mathbf{4}_4$: First embedded portion
4*a*: Auxiliary embedded portion
4*h*: Top surface
5, 5A: Outsole
6: Shoe sole
20: Upper midsole body
29: Lower midsole body
40: Connecting portion
50: Bonded surface
51: Ground contact surface
52: See-through portion
53: Frame portion
B9: Calcaneal bone
B9*u*: Sustentaculum talus
C: Axial line
D1: First area
D2: Second area
VL: Virtual curved line
Y: Front-rear direction

BEST MODE FOR CARRYING OUT THE INVENTION

The present invention will be understood more clearly from the following description of preferred embodiments taken in conjunction with the accompanying drawings. Note however that the embodiments and the drawings are merely illustrative, and the scope of the present invention shall be defined by the appended claims. In the accompanying drawings, like reference numerals denote like components throughout the plurality of figures.

An embodiment of the present invention will now be described with reference to the drawings.

Embodiment 1

FIGS. 1 to 13 show Embodiment 1.

Figure 10:
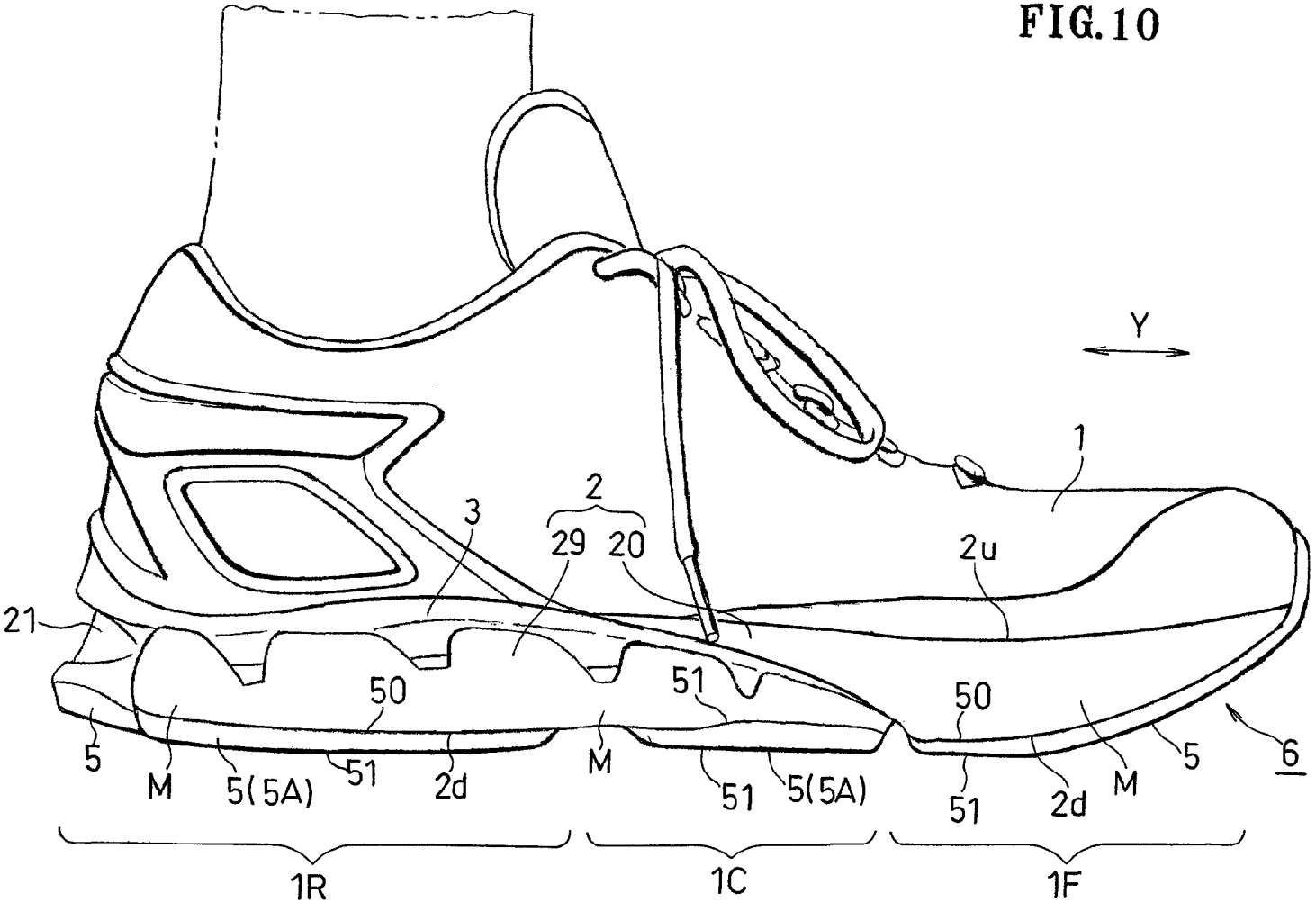
FIG. 10 is a side view showing a shoe as seen from the medial side.
Figure 11:
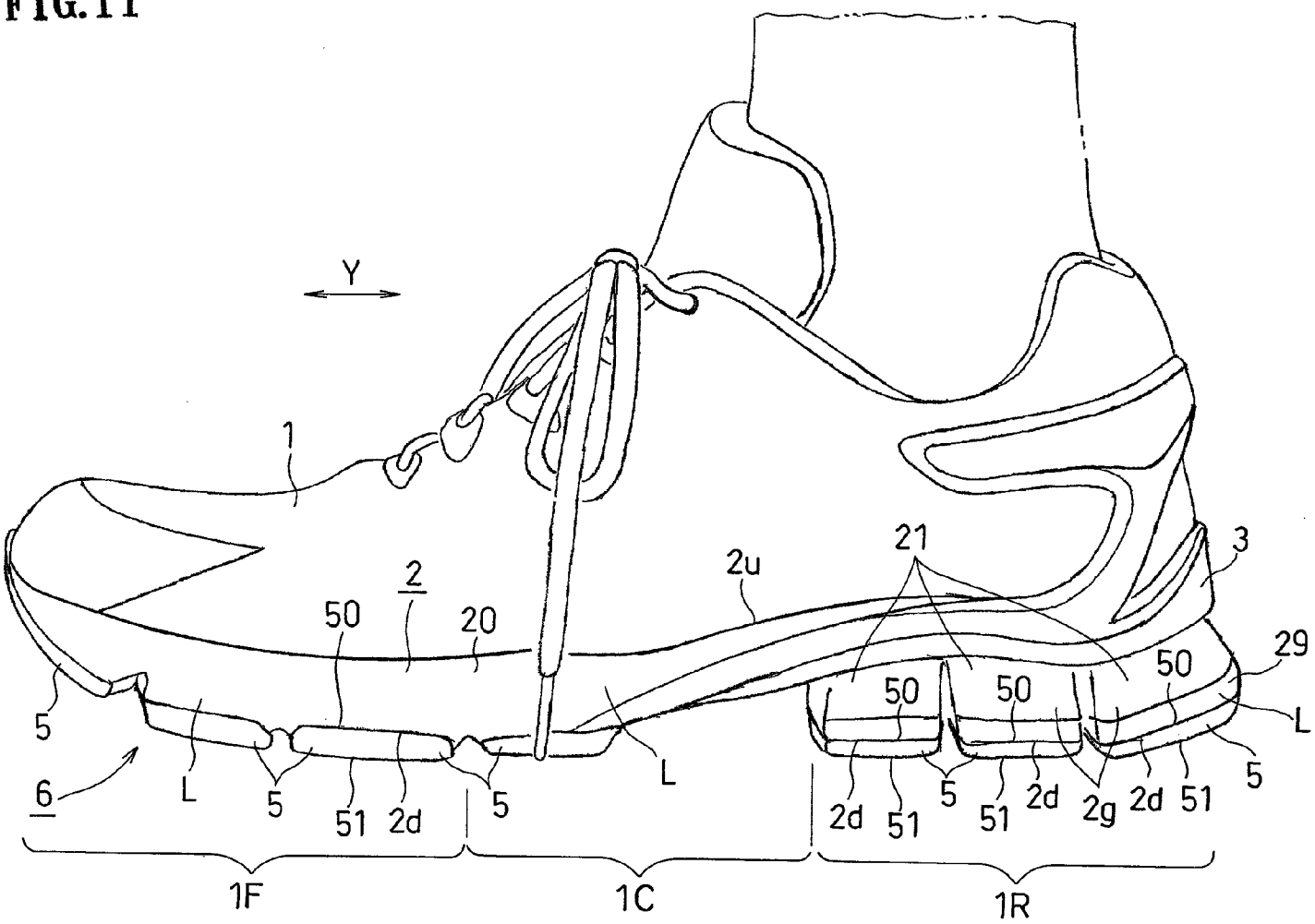
FIG. 11 is a side view showing the shoe as seen from the lateral side.

General Configuration:

In FIGS. 10 and 11, a shoe with a shoe sole 6 of the present invention includes an upper 1 that wraps around the instep, a midsole 2, a heel cup (an example of the resin plate) 3, an outsole 5, etc. The shoe sole 6 includes a front foot portion 1F, a middle foot portion 1C and a rear foot portion 1R provided continuous with one another in the front-rear direction Y of the foot.

In the present embodiment, the "front foot portion" is understood as being a portion of the foot in front of the head of the metatarsal bone B$\mathbf{4}_i$ shown in FIG. 1, for example, not including the arch. The "middle foot portion" refers to a portion placed between the front foot portion and the rear foot portion, including the shaft and the base of the metatarsal bone B$\mathbf{4}_i$, the cuneiform bone B$\mathbf{5}_i$, the navicular bone B6 and the cuboid bone B7, for example. The "rear foot portion" refers to a portion including the heel of the foot, e.g., the talus bone B8 and the calcaneal bone B9, for example.

The midsole 2 includes the upper surface 2*u* and the lower surface 2*d*, and absorbs the impact of landing. The outsole 5 has a bonded surface 50 to be bonded to the lower surface 2*d* of the midsole 2, and a ground contact surface 51 to be in contact with the road surface.

Figure 6:
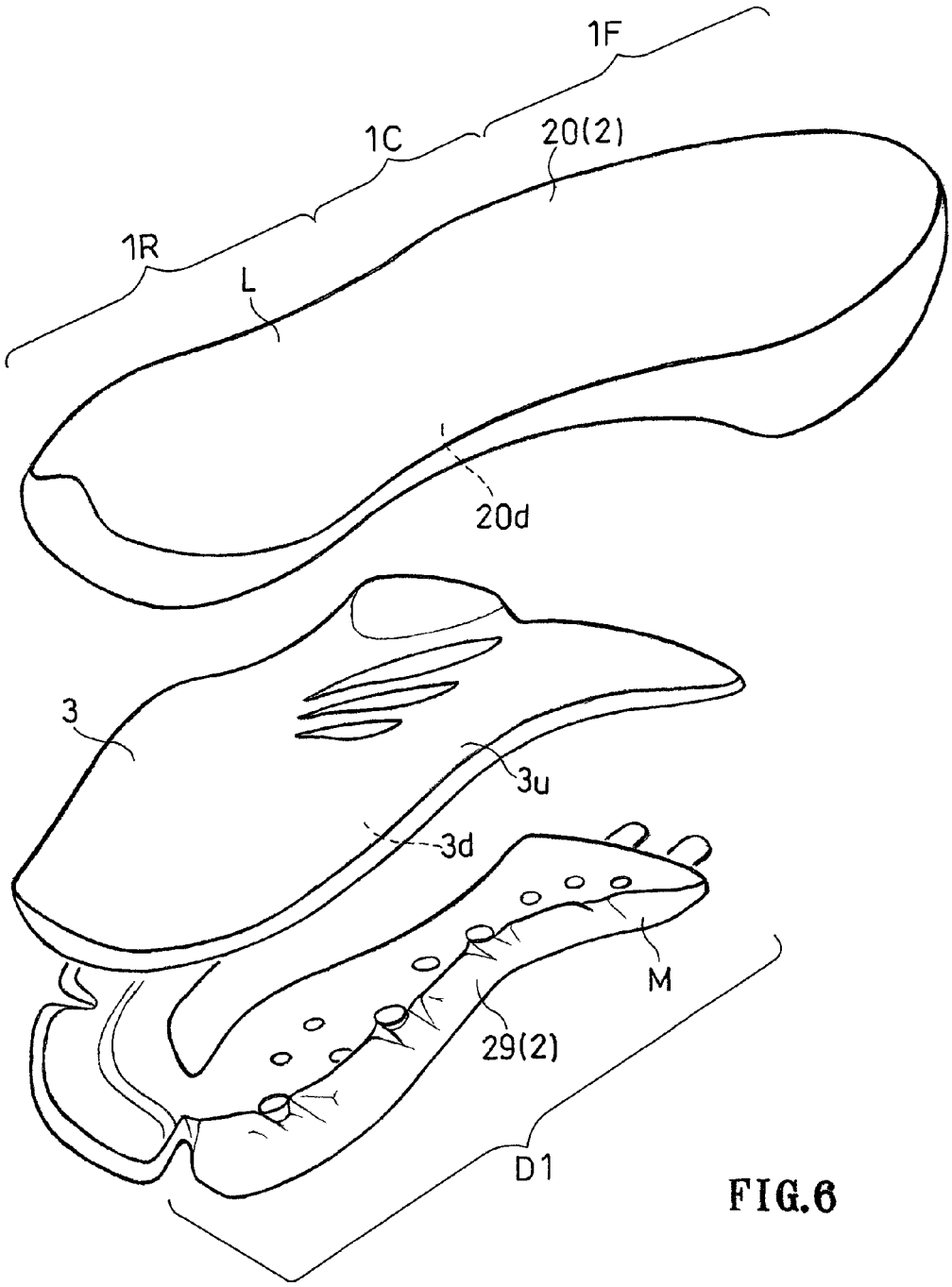
FIG. 6 is an exploded perspective view showing an upper midsole body, a heel cup and a lower midsole body.

In FIG. 6, the midsole 2 includes a midsole body 20, 29 which is divided into an upper midsole body 20 and a lower midsole body 29, and the midsole body 20, 29 is formed by a foamed resin such as EVA, for example. The midsole 2 includes the heel cup 3 (non-foamed resin plate), and the shock-absorbing element 21 (FIG. 11). A non-foamed resin having rubber elasticity, called a gel, may be employed, for example, as the shock-absorbing element 21.

Figure 5:
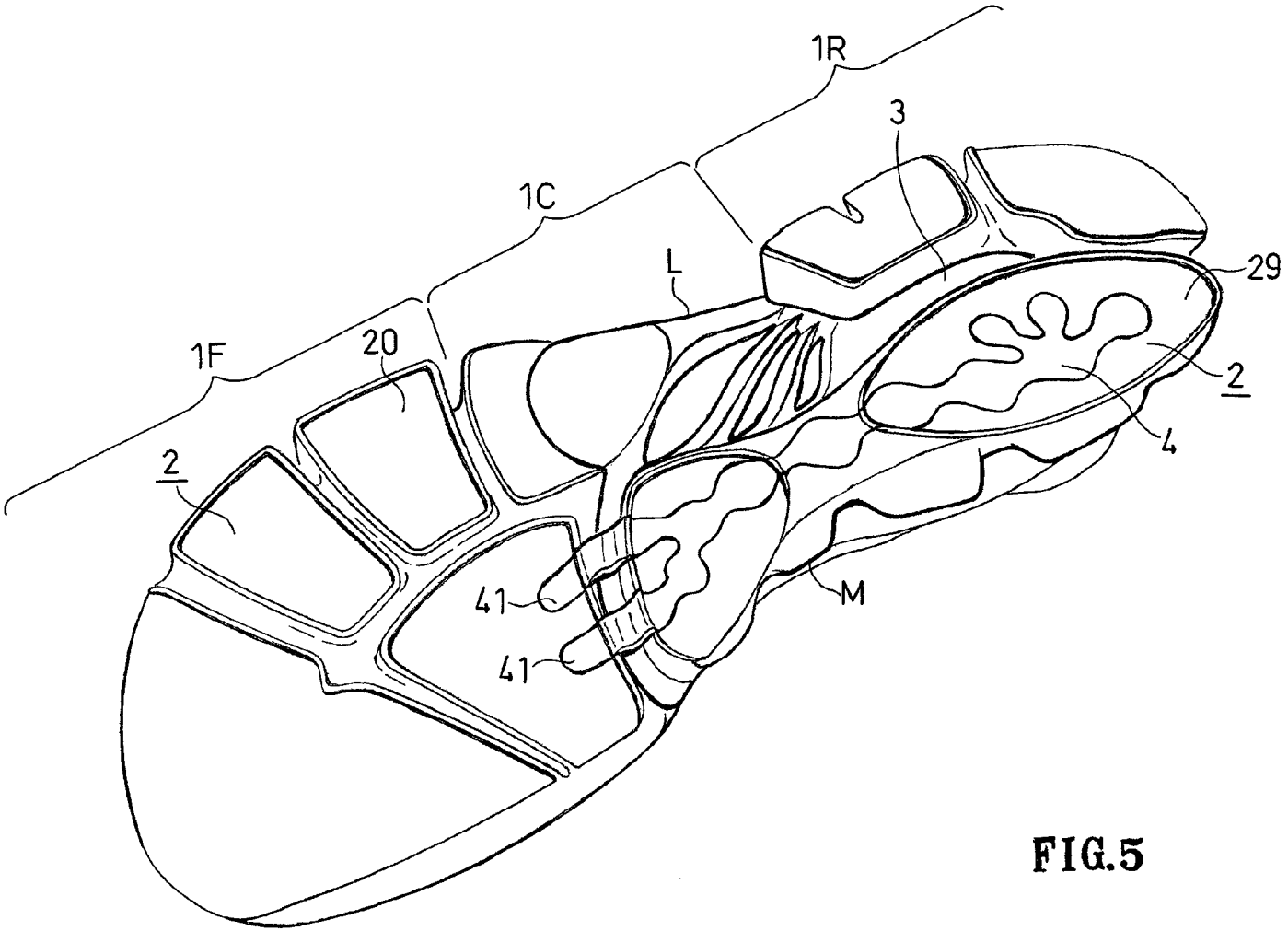
FIG. 5 is a perspective view showing a midsole body with a resin plate attached thereto as seen from below.

As shown in FIG. 5, the upper midsole body 20 extends across the entire area of the front foot portion 1F, the middle foot portion 1C and the rear foot portion 1R.

As shown in FIG. 6, the heel cup 3 is provided below the middle foot portion 10 and the rear foot portion 1R of the upper midsole body 20. The lower midsole body 29 is provided below the heel cup 3.

As shown in FIG. 11, in the rear foot portion 1R, the shock-absorbing element 21 is placed below the heel cup 3. The shock-absorbing element 21 is preferably a material having a better shock-absorbing property than the foamed material of the midsole 2, it may be for example a pod-like part which hermetically contains the air therein.

As shown in FIGS. 10 and 11, the bonded surface 50 of the outsole 5 is bonded to the lower surface 2*d* of the upper and lower midsole bodies 20 and 29. The outsole 5 is formed by a rubber which has a better wear resistance and a larger Young's modulus than the midsole 2.

Heel Cup 3:

The heel cup 3 is made of a non-foamed resin, and is bonded to the lower surface 20*d* of the middle foot portion 1C and the rear foot portion 1R of the upper midsole body 20 as shown in FIG. 6.

Figure 3A:
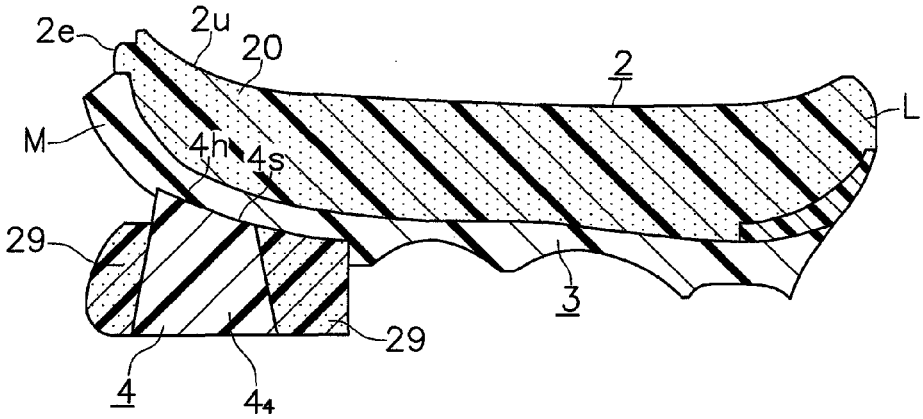
FIG. 3A is a cross-sectional view taken along line IIIA-IIIA in FIG. 1.
Figure 3B:
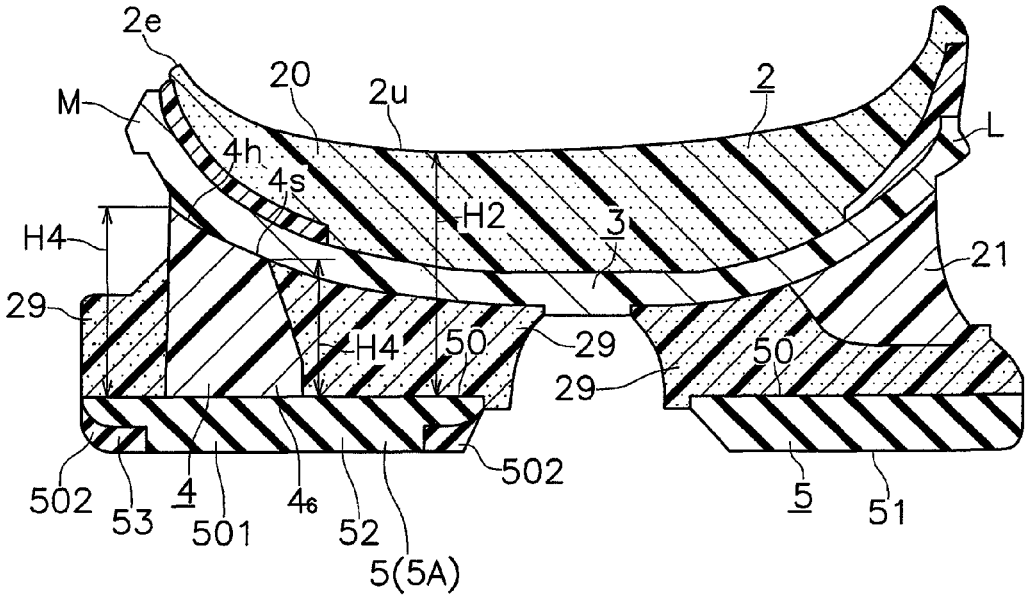
FIG. 3B is a cross-sectional view taken along line IIIB-IIIB in FIG. 1.

As shown in FIG. 3B, the heel cup 3 is generally boat-shaped, and has such a shape that it is rolled up so that it extends more upward toward the medial side M or the lateral side L. As shown in FIGS. 1 and 6, the heel cup 3 extends from the rear foot portion 1R toward the middle foot portion 10, and supports the medial side M and the lateral side L in the middle foot portion 1C and the rear foot portion 1R.

The lower midsole body 29 shown in FIG. 6 is bonded to a lower surface 3*d* of the heel cup 3. On the other hand, the upper midsole body 20 is bonded to an upper surface 3*u* of the heel cup 3.

First and Second Areas D1 and D2:

The midsole body 20, 29 is provided in a first area D1, which includes the medial side M of the middle foot portion 1C and the medial side M of the rear foot portion 1R, and in a second area D2, which includes the front foot portion 1F, the middle foot portion 10 and the rear foot portion 1R, excluding the first area D1, as shown in FIG. 1.

For example, the first area D1 is defined in an area which generally includes the shaft and the base of the first metatarsal bone B$\mathbf{4}_1$ of the middle foot portion 1C, the first cuneiform bone B$\mathbf{5}_1$, the navicular bone B6, and the medial side B9*m* of the calcaneal bone B9.

As shown in FIG. 6, the upper midsole body 20 is provided generally across the entire surface of the foot sole made up of the first area D1 and the second area D2. On the other hand, as shown in FIGS. 4A and 5, the lower midsole body 29 is formed in an integral "J"-letter shape including the first area D1 and the lateral side L (FIG. 1) of the middle foot portion 1C and the rear foot portion 1R.

Figure 8:
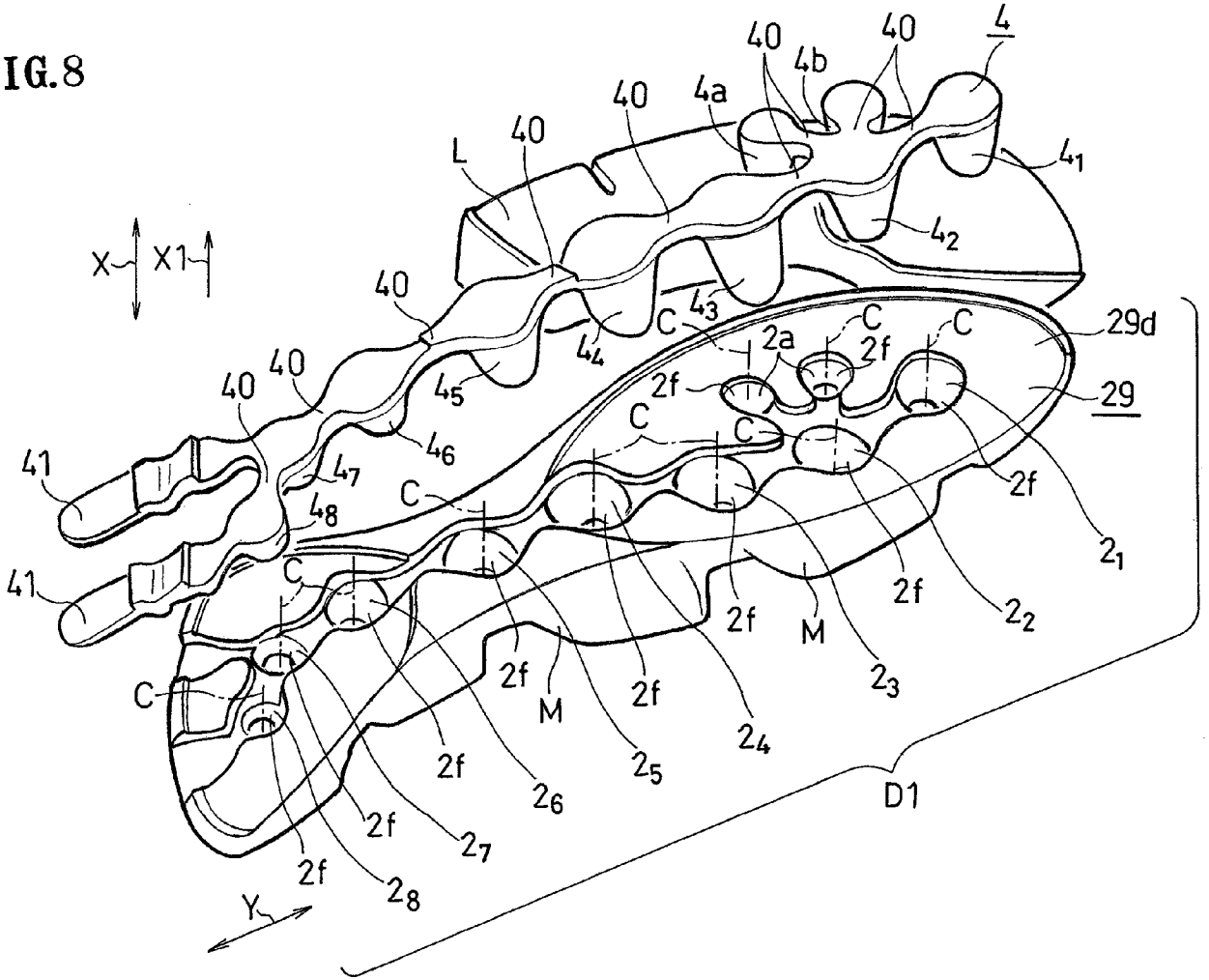
FIG. 8 is an exploded perspective view showing the hard member and the lower midsole body as seen from below.

Lower Midsole Body 29:

As shown in FIG. 8, on the medial side M of the lower midsole body 29, i.e., in a lower portion 29*d* in the first area D1, many holes $\mathbf{2}_i$ are formed separated from one another in the front-rear direction Y. Each hole $\mathbf{2}_i$ is opened in the downward direction X1 (the upward direction of FIG. 8), and has an inner peripheral surface 2*f* about an axial line C which extends in the up-down direction X.

Hard Member 4:

Many holes $\mathbf{2}_i$ into which embedded portions $\mathbf{4}_i$ of a hard member 4 of FIG. 4B are fitted are provided in the first area D1 of the lower midsole body 29 of FIG. 4A.

The hard member 4 shown in FIG. 4B includes the connecting portions 40 connecting together the embedded portions $\mathbf{4}_i$.

Figure 9:
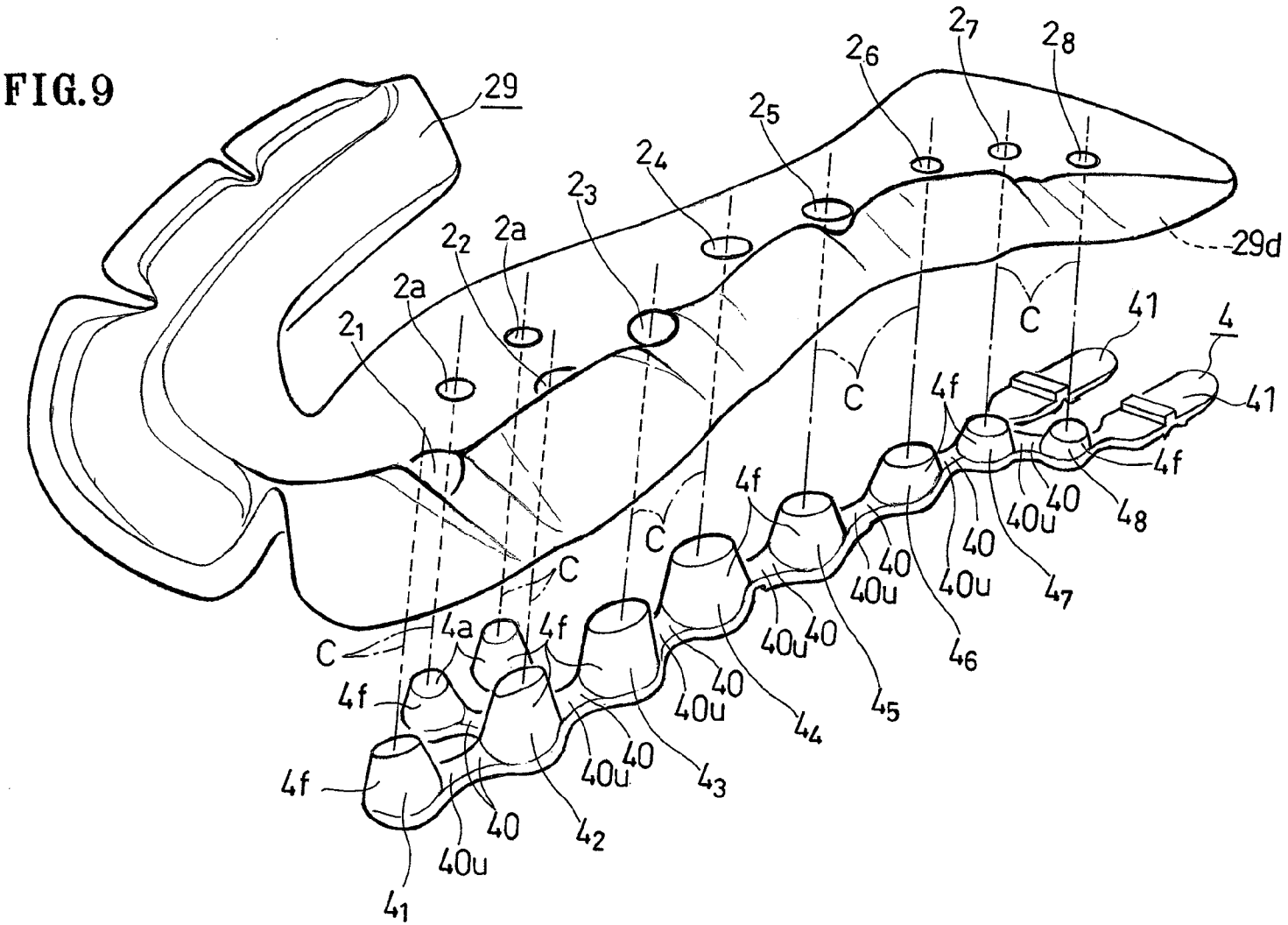
FIG. 9 is an exploded perspective view showing the hard member and the lower midsole body.

An upper surface 40*u* of each connecting portion 40 shown in FIG. 9 is secured to a lower surface 29*d* of the lower midsole body 29 shown in FIG. 8. On the other hand, outer peripheral surfaces 4*f* of the embedded portions $\mathbf{4}_i$ are secured to the lower midsole body 29 on the inner peripheral surfaces 2*f* (FIG. 8) of the holes $\mathbf{2}_i$.

Note that as shown in FIG. 5, the front end portion of the hard member 4 is integrally formed with fixed end portions 41 with which the front end portion of the hard member 4 is secured to the upper midsole body 20.

The JIS-C hardness of the material of the midsole body 20, 29 is set to 45° to 65°. The JIS-A hardness of the hard member 4 is set to 55° to 95°.

Embedded Portion $\mathbf{4}_i$:

As shown in FIG. 4A, a first hole $\mathbf{2}_4$, which has the largest cross-sectional area along the cross section generally perpendicular to the axial line C (FIGS. 8 and 9) among the holes $\mathbf{2}_i$, is provided in the middle portion of the first area D1 of the lower midsole body 29 in the front-rear direction Y.

On the other hand, as shown in FIG. 4C, a first embedded portion $\mathbf{4}_3$, which has the largest height H among the embedded portions $\mathbf{4}_i$, is provided in the middle portion of the first area D1 (FIG. 1) in the front-rear direction Y.

In the portion of the medial side B9*m* in a front portion of the calcaneal bone B9 shown in FIG. 1, the arch is highest and the midsole 2 is also thick. Therefore, in this portion, the first embedded portion $\mathbf{4}_3$ having the largest height H shown in FIG. 4C is placed, thereby obtaining a significant pronation suppressing effect.

The embedded portions $\mathbf{4}_1$ to $\mathbf{4}_2$ of the embedded portions $\mathbf{4}_i$ have gradually smaller heights H in the rearward direction Y2 past the first embedded portion $\mathbf{4}_3$, and the embedded portions $\mathbf{4}_4$ to $\mathbf{4}_8$ have gradually smaller heights H in the frontward direction Y1 past the first embedded portion $\mathbf{4}_3$.

Thus, the heights H of the embedded portions $\mathbf{4}_i$ are varied according to the thickness of the lower midsole body 29 (FIGS. 3A and 3B).

Figure 12:
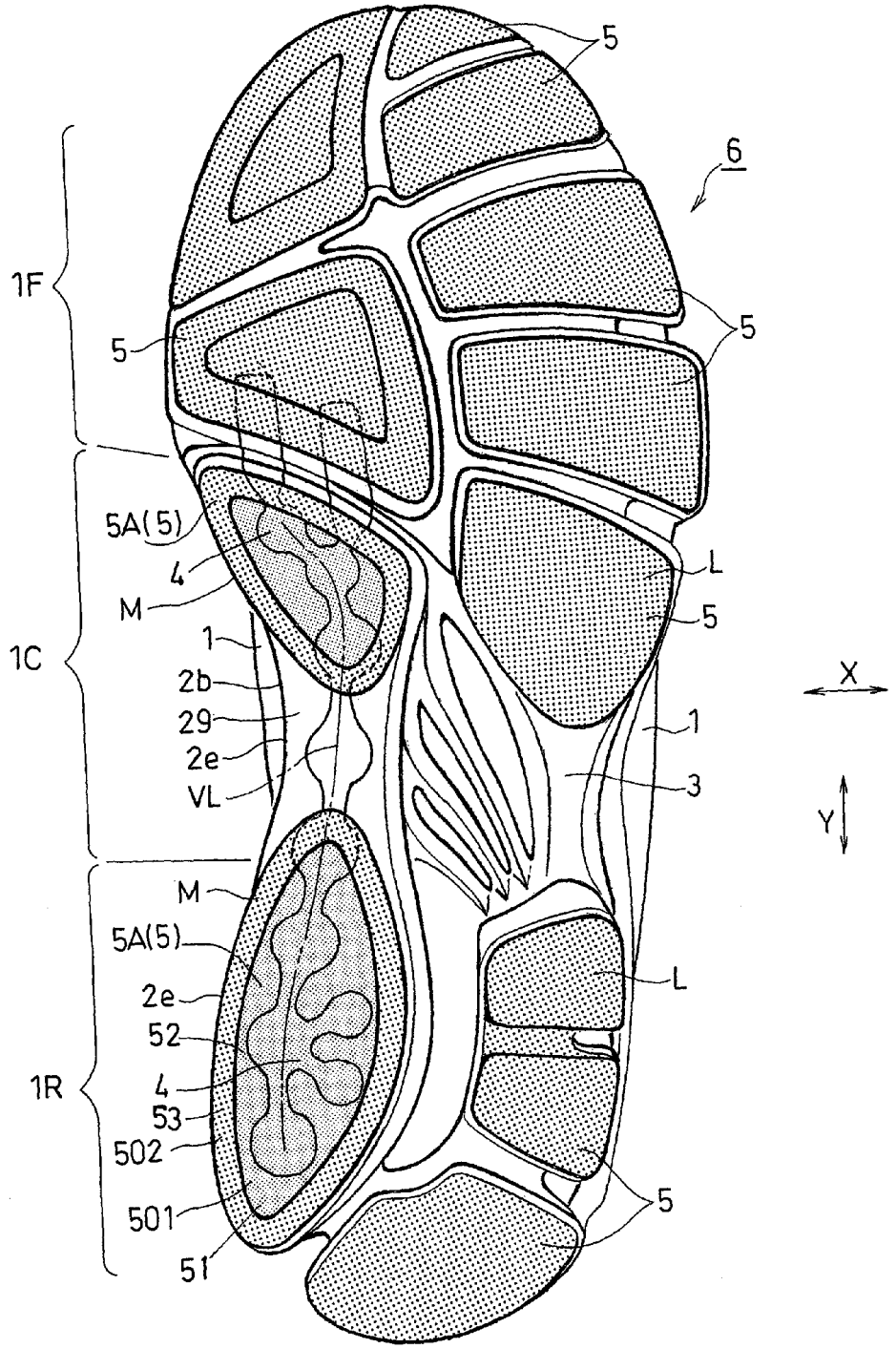
FIG. 12 is a bottom view showing the shoe sole.

As shown in FIG. 12, an edge 2*e* on the medial side M of the shoe sole 6 has a narrowed portion 2*b* in the middle foot portion 1C.

It is preferred that five or more embedded portions $\mathbf{4}_i$ are provided from the middle foot portion 1C toward the rear foot portion 1R. In Embodiment 1, eight embedded portions $\mathbf{4}_i$ are provided.

The embedded portions $\mathbf{4}_i$ are placed on a virtual curved line VL which is shaped along the medial edge 2*e* of the middle foot portion 10 and the edge 2*e* of the rear foot portion 1R, and along the narrowed portion 2*b*.

As shown in FIG. 3B, the distance H2 from the bonded surface 50 of the outsole 5 to the upper surface 2*u* of the midsole 2 gradually increases toward the edge 2*e* of the medial side M on the medial side M of the middle foot portion 10 (FIG. 1) and on the medial side M of the rear foot portion 1R. That is, as shown in FIGS. 3A and 3B, the distance from the bonded surface 50 to the upper surface 2*u* of the midsole 2 gradually increases toward the edge 2*e* of the medial side M in conformity with the shape of the foot sole.

As shown in FIG. 3B, the distance H4 from the bonded surface 50 of the outsole 5 to a top surface 4*h* of the embedded portion 4 gradually increases toward the edge 2*e* of the medial side M as does the distance H2. That is, the distances H2 and H4 both gradually increase toward the edge 2*e* of the medial side. Therefore, the distance H2 gradually increases toward the edge 2*e* of the medial side while the distance H4 also gradually increases toward the medial edge 2*e*, and therefore the upper midsole body 20 is thinner on the medial edge 2*e* as shown in FIG. 3B.

The top surface 4*h* of each embedded portion $\mathbf{4}_i$ is inclined so that it extends diagonally upward toward the edge 2*e* of the medial side in conformity with the rolled-up shape of the edge 2*e* of the upper midsole body 20. That is, the top surface 4*h* of the embedded portion $\mathbf{4}_i$ is inclined along an upper surface 29*u* of the lower midsole body 29.

Relationship Between Embedded Portions $\mathbf{4}_i$ and Bones:

As shown in FIG. 1, the lower surface of the calcaneal bone B9 is generally hemispheric, and the sustentaculum talus B9*u* in the front portion of the rear foot portion 1R is placed in an upper portion. Therefore, the calcaneal bone B9 easily leans to the medial side M of the heel. Therefore, when a runner runs wearing a shoe with a flat shoe sole different from Embodiment 1, the runner lands on the lateral side of the heel of the foot, and then the heel easily leans on the medial side M, resulting in excessive pronation.

In contrast, with the shoe sole 6 of Embodiment 1, the first embedded portion $\mathbf{4}_3$ (FIG. 4C) having the largest height H among the embedded portions $\mathbf{4}_i$ is placed even more medial of (than) the medial side B9*m* in the front portion of the sustentaculum talus B9*u* of the calcaneal bone B9.

That is, two or more of the embedded portions $\mathbf{4}_i$ provided on the medial side M of the rear foot portion 1R are placed more medial of (than) the portion (the coarsely dotted portion) of the calcaneal bone B9 excluding the sustentaculum talus B9*u* (the finely dotted portion) of the calcaneal bone B9.

As described above, by placing the hard embedded portions $\mathbf{4}_i$ which do not easily undergo compressive deformation on the medial side M of the rear foot portion 1R, excessive leaning of the heel is suppressed. That is, excessive pronation is suppressed.

Auxiliary Embedded Portion 4*a:*

On the medial side M of the rear foot portion 1R shown in FIG. 1, auxiliary embedded portions 4*a* are provided in portions closer to the center of the calcaneal bone B9 than the embedded portions $\mathbf{4}_1$ to $\mathbf{4}_3$ provided on the medial edge 2*e*. As shown in FIG. 4A, auxiliary holes 2*a* are provided in portions of the lower midsole body 29 corresponding to the auxiliary embedded portions 4*a*.

As shown in FIG. 4C, the auxiliary embedded portions 4*a* are lower than the embedded portions $\mathbf{4}_1$ to $\mathbf{4}_3$ provided on the medial edge.

Figure 7:
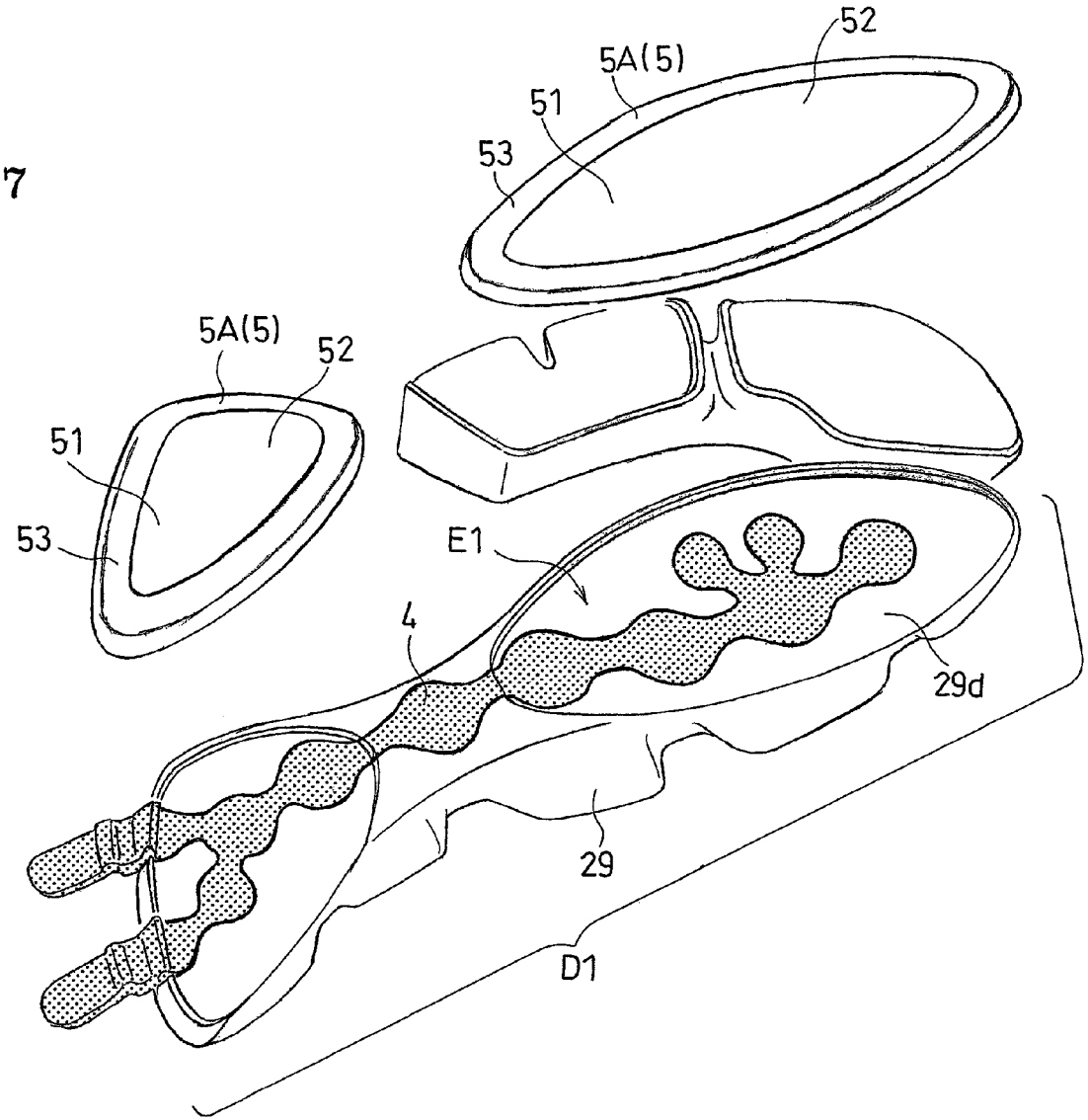
FIG. 7 is a perspective view showing the lower midsole body with the hard member fixed thereto, and an outsole as seen from below.

See-Through Portion 52:

As shown by the dotted area of FIG. 7, the color of the lower midsole body 29 is different from the color of the hard member 4.

Figure 13:
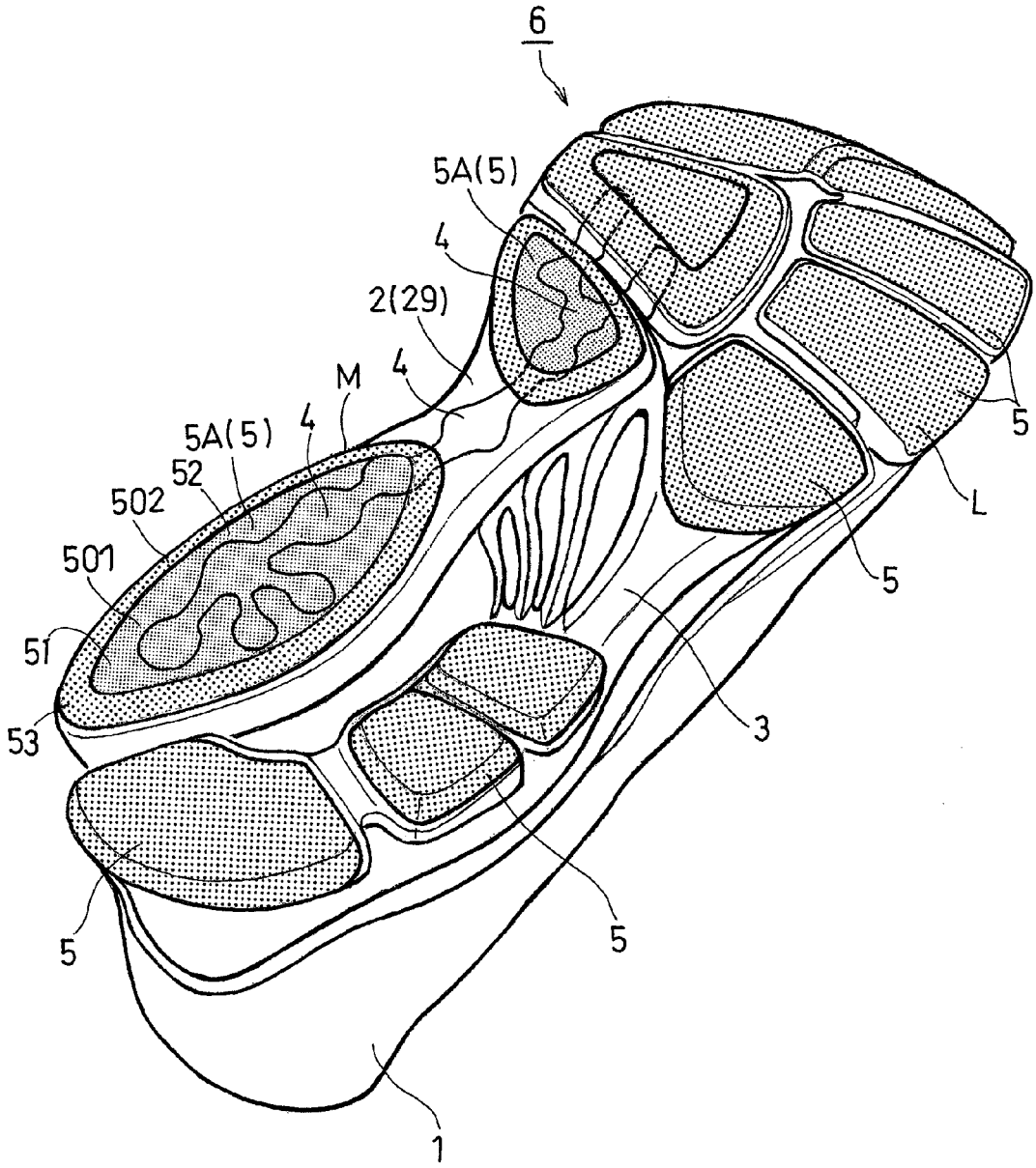
FIG. 13 is a perspective view showing the shoe as seen from below.

As shown in FIGS. 12 and 13, the outsole 5 is made up of a plurality of parts, and outsole parts 5A placed in the first area D1 (FIG. 1) include see-through portions 52 indicated by finely-dotted areas. The see-through portion 52 is formed by a semitransparent rubber 501 in which silica ($SiO_2$) is used as a reinforcing filler. Therefore, the hard member 4 can be seen through the see-through portion 52 from the ground contact surface 51 of the outsole parts 5A.

The two outsole parts 5A placed in the first area D1 include a frame portion 53 provided in a loop shape along the periphery of the see-through portion 52, and the see-through portion 52 formed integrally with the frame portion 53. The frame portion 53 is formed by a black rubber 502 in which carbon black is used as a reinforcing filler.

As shown in FIG. 3B, the semitransparent rubber 501 forming the see-through portion 52 is provided in portions other than the lower portion of the periphery of the part 5A, whereas the black rubber 502 is provided in the lower portion of the periphery of the part 5A. The rubbers 501 and 502 are integrated together during vulcanization.

Embodiment 2

Figure 14A:
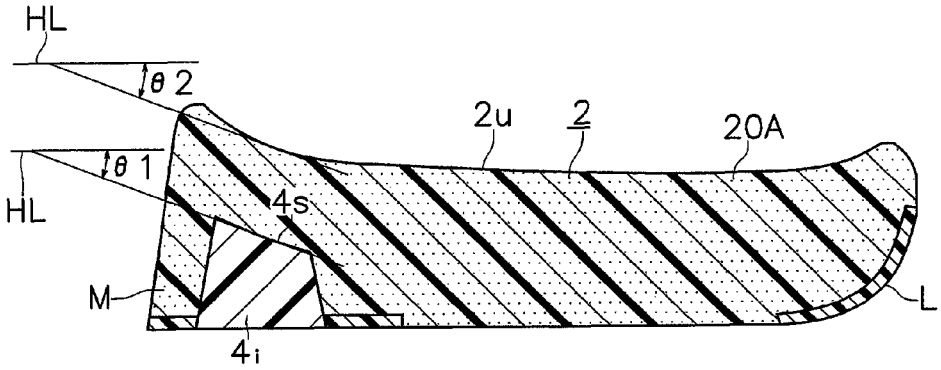
FIG. 14A is a cross-sectional view showing a middle foot portion according to Embodiment 2 of the present invention.
Figure 14B:
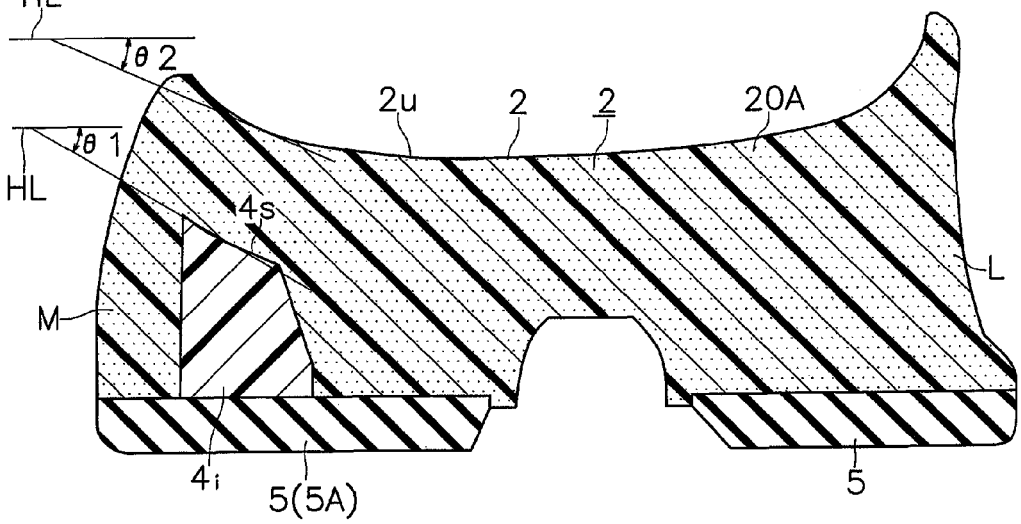
FIG. 14B is a cross-sectional view showing a rear foot portion.

FIGS. 14A and 14B show Embodiment 2.

In the present embodiment, above the embedded portion $\mathbf{4}_i$, the upper surface 2*u* of a midsole body 20A and a slope surface 4*s* of the embedded portions $\mathbf{4}_i$ are generally parallel to each other.

More preferably, the angle θ1 of the slope surface 4*s* with respect to the horizontal line HL is greater than the angle θ2 of the upper surface 2*u* of the midsole with respect to the horizontal line HL. With such settings, the thickness of the midsole body 20A does not increase toward the edge on the medial side M above the embedded portions $\mathbf{4}_i$. Therefore, the foot less easily leans on the medial side.

Note that the heel cup is absent in Embodiment 2.

The other configuration is similar to that of Embodiment 1, like components are denoted by like reference numerals and will not be described below.

Next, an example of the structure of the embedded portions $\mathbf{4}_i$ and the holes $\mathbf{2}_i$ will be described.

Figure 15A:
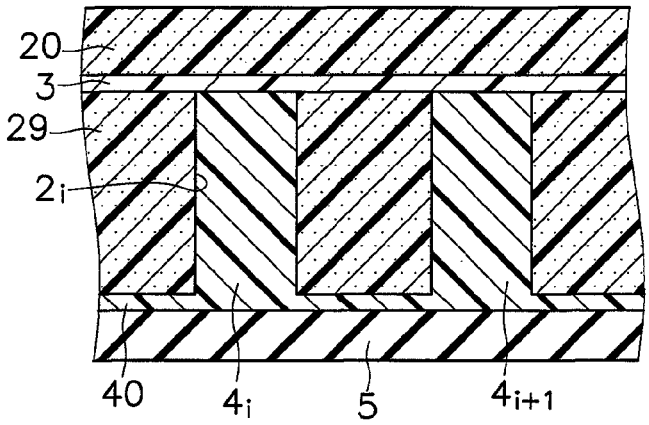
FIGS. 15A, 15B and 15C are schematic sectional views each showing an example of a structure of embedded portions and holes.
Figure 15B:
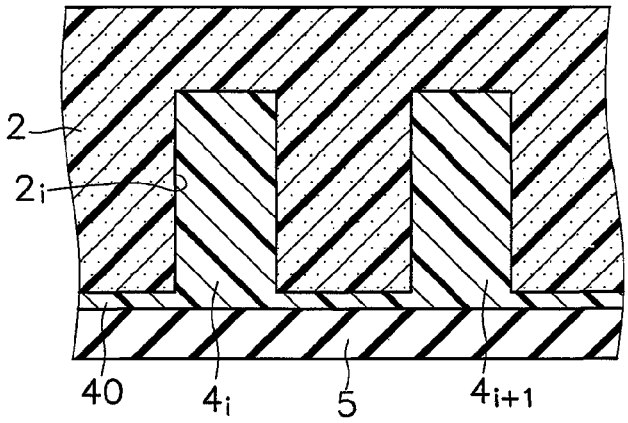

FIGS. 15A and 15B schematically show the structures of Embodiments 1 and 2, respectively.

Figure 15C:
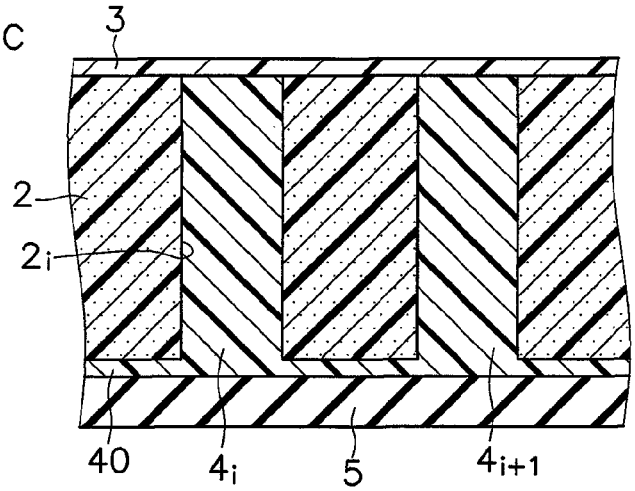

In the example shown in FIG. 15C, the midsole body is not provided on the heel cup 3.

Figure 16A:
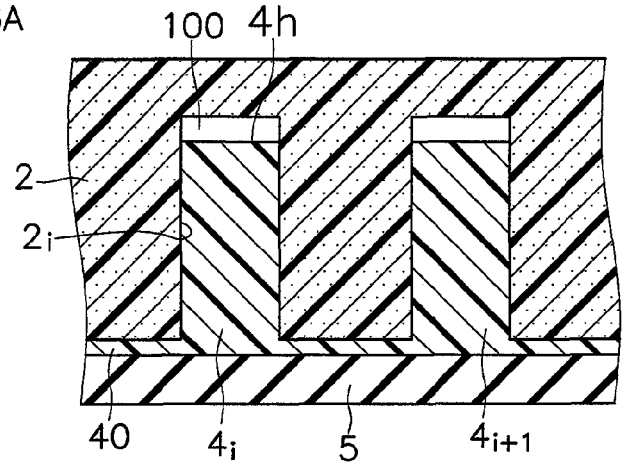
FIGS. 16A, 16B and 16C are schematic sectional views each showing an example of a structure of embedded portions and holes.

In the example shown in FIG. 16A, a gap 100 is present between the lower surface of the midsole 2 in the hole $\mathbf{2}_i$ and the top surface 4*h* of the embedded portion $\mathbf{4}_i$. Such a gap 100 may occur due to manufacturing technical limitations. In such a case, the height of the gap 100 is often 2.0 to 3.0 mm or less.

Figure 16B:
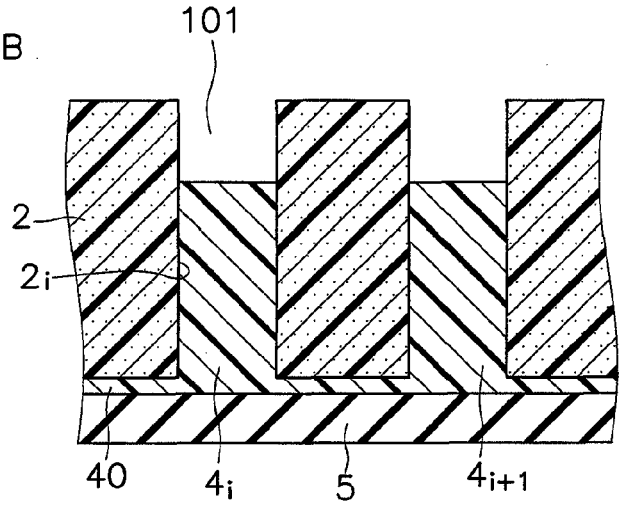
Figure 16C:
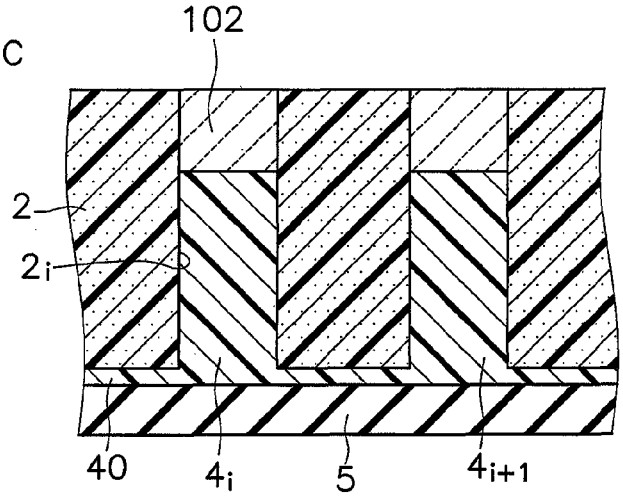

In the example shown in FIG. 16B, the hole $\mathbf{2}_i$ runs through the midsole 2 in the up-down direction, and an opening 101 (void) is present in an upper portion of the hole $\mathbf{2}_i$. In such a case, a filler member 102 shown in FIG. 16C may be embedded in the opening 101. A member that is softer or harder than the member of the midsole 2 is inserted as the filler member 102.

Where there is the opening 101 of FIG. 16B, it will be possible to obtain the pronation suppressing effect if the inner peripheral surface of the hole $\mathbf{2}_i$ and the outer peripheral surface of the embedded portion $\mathbf{4}_i$ are secured (bonded) together so that they do not slip against each other.

Figure 17A:
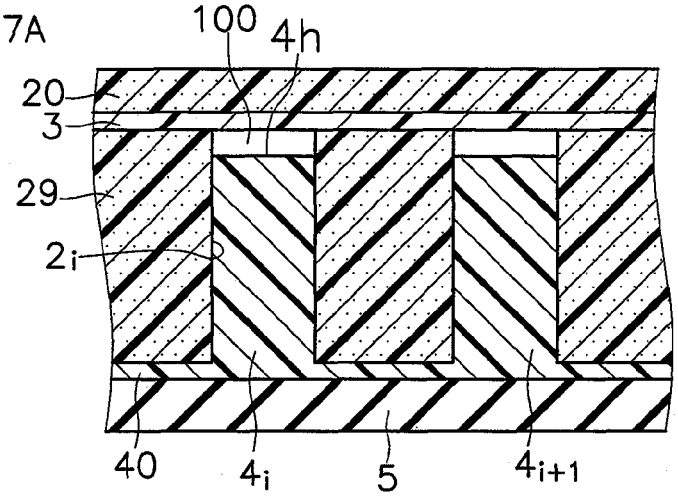
FIGS. 17A, 17B and 17C are schematic side views each showing an example of a structure of embedded portions and holes.

In the case shown in FIG. 17A, the gap 100 is present between the lower surface of the heel cup 3 in the hole $\mathbf{2}_i$ and the top surface 4*h* of the embedded portion $\mathbf{4}_i$. Such a gap 100 may occur due to manufacturing technical limitations.

Figure 17B:
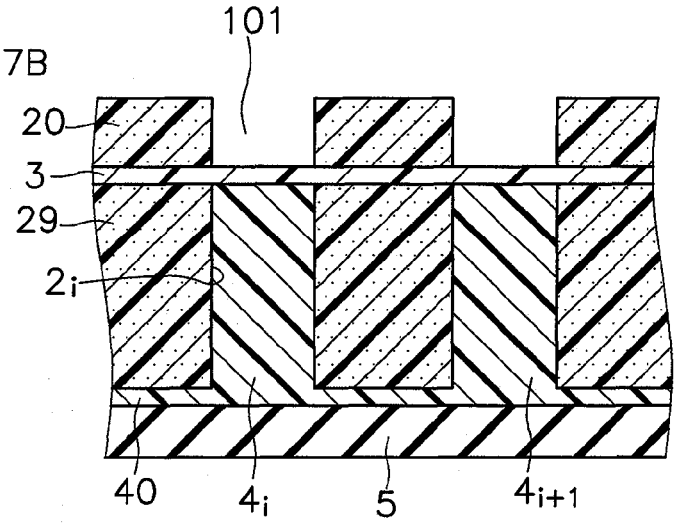
Figure 17C:
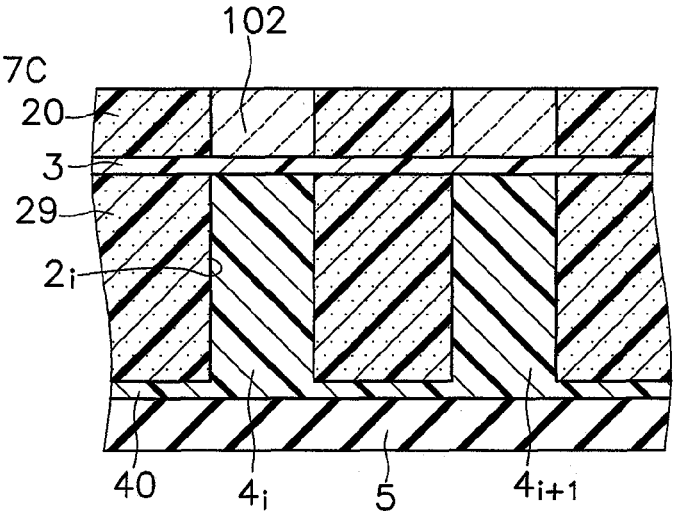

In the case shown in FIG. 17B, the opening 101 is present in the upper midsole body 20. In such a case, the filler member 102 shown in FIG. 17C may be embedded in the opening 101.

In the examples described above, if the gap 100 of FIGS. 16A and 17A is very small, e.g., if the height of the gap 100 is 2.0 to 3.0 mm or less, it will have no significant influence on the pronation suppressing effect. That is, the distance between the top surface of the hole $\mathbf{2}_i$ and the top surface 4*h* of the embedded portion $\mathbf{4}_i$ is preferably 2.0 mm to 3.0 mm or less.

On the other hand, where the height of the gap 100 is over 5 mm, the pronation suppressing effect will lower. Even in such a case, however, it will be possible to obtain the pronation suppressing effect if the inner peripheral surface of the hole $\mathbf{2}_i$ and the outer peripheral surface of the embedded portion $\mathbf{4}_i$ are secured (bonded) together so that they do not slip against each other.

While preferred embodiments have been described above with reference to the drawings, various obvious changes and modifications will readily occur to those skilled in the art upon reading the present specification.

For example, the hard member may be provided only in one row in the front-rear direction.

The hard member may be separated into two, front and rear, portions.

The embedded portions may be provided only in one of the rear foot portion and the middle foot portion. That is, the first area may be provided only in one of the middle foot portion and the rear foot portion.

The auxiliary embedded portions may be provided as necessary

A gap may be present between the top surface of the embedded portion and the heel cup. Where the heel cup is absent, a gap may be present between the top surface of the embedded portion and the midsole body.

An outsole having a see-through portion enhances the design aesthetics of the shoe sole even when the embedded portions are absent. In such a case, resin parts with figures and patterns thereon may be provided on the lower surface of the midsole, instead of the embedded portions.

The outsole may be provided across the entire first area.

The hardness of the midsole body in the first area may be larger than that of the midsole body in the second area.

Thus, such changes and modifications are deemed to fall within the scope of the present invention, which is defined by the appended claims.

INDUSTRIAL APPLICABILITY

The present invention is applicable to athletic shoes that are worn in daily lives, sports and competitions.

The invention claimed is:

1. A shoe sole suitable for suppressing pronation, wherein:

the shoe sole includes a front foot portion, a middle foot portion and a rear foot portion continuous with one another in a front-rear direction of a foot, the shoe sole comprising:

a midsole having an upper surface and a lower surface and absorbing an impact of landing; and an outsole having a bonded surface to be bonded to the lower surface of the midsole, and a ground contact surface to be in contact with a road surface;

the midsole includes a midsole body formed by a foamed resin;

the midsole body is provided in a first area including a medial side of the middle foot portion and/or a medial side of the rear foot portion, and in a second area including the front foot portion, the middle foot portion and the rear foot portion excluding the first area;

the midsole body has three or more holes in a lower portion of the first area, the holes being separated from one another in the front-rear direction, the holes each opening in a downward direction and having an inner peripheral surface about an axial line extending in an up-down direction;

three or more embedded portions are provided;

the embedded portions each have an outer peripheral surface about the axial line, and are embedded in the midsole body while being fitted into the holes;

the embedded portions each are formed by a hard member made of a resin harder than the midsole body and the outsole; and the hard member includes a connecting portion for connecting together the embedded portions in the front-rear direction on the lower surface of the midsole body.

2. A shoe sole according to claim 1, wherein a first hole having a largest cross-sectional area along a cross section perpendicular to the axial line among the holes is placed in a middle portion of the first area in the front-rear direction.

3. A shoe sole according to claim 1, wherein a first embedded portion having a largest height among the embedded portions is placed in a middle portion of the first area in the front-rear direction.

4. A shoe sole according to claim 1, wherein:

a first embedded portion having a largest height among the embedded portions is placed on a medial side of a front portion of a calcaneal bone or at a position more medial than the front portion of the calcaneal bone;

the embedded portions other than the first embedded portion have gradually smaller heights in a rearward direction past the first embedded portion; and the embedded portions other than the first embedded portion have gradually smaller heights in a forward direction past the first embedded portion.

5. A shoe sole according to claim 1, wherein:

a distance from the bonded surface of the outsole to the upper surface of the midsole increases toward an edge of the medial side of the middle foot portion and an edge of the medial side of the rear foot portion;

the edge on the medial side includes a narrowed portion in the middle foot portion;

five or more embedded portions are provided from the middle foot portion to the rear foot portion; and the embedded portions are placed on a virtual curved line which is shaped along the edge of the middle foot portion and the edge of the rear foot portion and along the narrowed portion.

6. A shoe sole according to claim 5, wherein the embedded portions each have a top surface, and the top surface of each of the embedded portions is inclined so as to extend diagonally upward toward the medial edge.

7. A shoe sole according to claim 1, wherein:

a distance from the bonded surface of the outsole to the upper surface of the midsole increases toward an edge of the medial side of the middle foot portion and an edge of the medial side of the rear foot portion; and the embedded portions each have a top surface, and the top surface of each of the embedded portions is inclined so as to extend diagonally upward toward the edges.

8. A shoe sole according to claim 7, wherein:

the midsole body is further provided in an upper portion of the first area which is upward of the lower portion of the first area; and the top surface is inclined along an upper surface of the midsole body above each of the embedded portions whose top surface is inclined.

9. A shoe sole according to claim 8, wherein:

on the medial side of the rear foot portion, an auxiliary embedded portion is provided in a portion closer to a center of a calcaneal bone than the embedded portions provided on the medial edge; and a height of the auxiliary embedded portion is smaller than that of the embedded portions provided on the medial edge.

10. A shoe sole according to claim 1, wherein two or more of the embedded portions provided on the medial side of the rear foot portion are placed more medial than a portion of a calcaneal bone excluding a sustentaculum talus of the calcaneal bone.

11. A shoe sole according to claim 1, wherein an upper surface of the connecting portion is secured to the lower surface of the midsole body.

12. A shoe sole according to claim 11, wherein:

the outer peripheral surface of each of the embedded portions is secured to the midsole body on the inner peripheral surface of each of the holes, thereby suppressing compressive deformation in an up-down direction of the lower portion of the first area around the holes; and the lower portion of the first area thereby less easily undergoes compressive deformation than the midsole body in an upper portion of the first area and in the second area.

13. A shoe sole according to claim 1, wherein:

the midsole includes a plate made of a non-foamed resin covering over the embedded portions in the first area; and the midsole body includes a lower midsole body bonded to a lower surface of the plate, and an upper midsole body bonded to an upper surface of the plate.

14. A shoe sole according to claim 13, wherein each of the holes runs in an up-down direction through the lower midsole body.

15. A shoe sole according to claim 1, wherein:

a color of the midsole body is different from a color of the hard member; and the outsole placed in the first area includes a see-through portion formed by a semitransparent rubber, and the hard member is viewable through the see-through portion from below the outsole.

16. A shoe sole according to claim 15, wherein:

the outsole is made up of a plurality of parts, and a part placed in the first area includes a frame portion provided in a loop shape along a periphery of the see-through portion, and the see-through portion formed integrally with the frame portion; and the frame portion is formed by a black rubber in which carbon black is used as a reinforcing filler.

17. A shoe sole according to claim 1, wherein a JIS-C hardness of a material of the midsole body is set to a value in the range of 45° to 65°, and a JIS-A hardness of the hard member is set to a value in the range of 55° to 95°.

* * * * *